US007051462B1

(12) United States Patent
Rosenzweig

(10) Patent No.: US 7,051,462 B1
(45) Date of Patent: May 30, 2006

(54) COMBINED STEAM CLEANER AND STEAM IRON APPARATUS AND CIRCUIT

(75) Inventor: Maximilian Rosenzweig, Montreal (CA)

(73) Assignee: Euro-Pro Operating, LLC, West Newton, MA (US)

( * ) Notice: Subject to any disclaimer, the term of this patent is extended or adjusted under 35 U.S.C. 154(b) by 0 days.

(21) Appl. No.: 11/177,135

(22) Filed: Jul. 8, 2005

(51) Int. Cl.
*D06F 75/40* (2006.01)
*D06C 7/00* (2006.01)

(52) U.S. Cl. ..... 38/75; 68/222

(58) Field of Classification Search ..... 38/75, 38/77.1, 77.3, 77.6, 77.9, 82, 85, 88; 219/245, 219/246, 247, 250, 254, 255, 259; 68/222; 392/401; 15/320, 321, 322
See application file for complete search history.

(56) References Cited

U.S. PATENT DOCUMENTS

| | | | | |
|---|---|---|---|---|
| 3,869,815 | A * | 3/1975 | Bullock | 38/77.6 |
| 4,875,301 | A * | 10/1989 | Adams | 38/14 |
| 5,042,179 | A | 8/1991 | van der Meer | |
| 5,400,462 | A | 3/1995 | Amoretti | |
| 5,581,919 | A | 12/1996 | Torma et al. | |
| 5,609,047 | A * | 3/1997 | Hellman et al. | 68/222 |
| 6,061,935 | A | 5/2000 | Lee | |
| 6,067,403 | A * | 5/2000 | Morgandi | 392/401 |
| 6,233,853 | B1 * | 5/2001 | Buchmann | 38/77.6 |
| 6,243,535 | B1 | 6/2001 | Bochud | |
| 6,711,840 | B1 | 3/2004 | Rosenzweig | |

FOREIGN PATENT DOCUMENTS

| | | |
|---|---|---|
| DE | 0 197 424 65 | 4/1999 |
| EP | 0 809 728 B1 | 12/1997 |
| EP | 0 982 429 | 3/2000 |
| FR | 0 027 144 01 | 6/1995 |

* cited by examiner

*Primary Examiner*—Ismael Izaguirre
(74) *Attorney, Agent, or Firm*—Greenberg Traurig, LLP; Michael I. Wolfson; Sylvia Tan

(57) ABSTRACT

A combination steam cleaner and steam iron includes a steam generator, a steam cleaner and a steam iron. The steam generator includes a voltage control device serially connected to a boiler element for boiling water to produce steam. The steam cleaner is attachable to the steam generator, a nozzle that dispenses the steam, and a circuit designed to supply power to the boiler element when the steam cleaner is attached to the steam generator. The steam iron is attachable to the steam generator, includes an iron heating element for heating the iron, and includes a circuit designed to supply power to the iron heating element in addition to supplying power to the boiler element, when the steam iron is attached to the steam generator. The steam generator also includes a steam release valve that supplies the steam and which is controlled by respective switches within the steam cleaner and iron.

24 Claims, 4 Drawing Sheets

COMBINED STEAM CLEANER AND STEAM IRON APPARATUS AND CIRCUIT

BACKGROUND OF THE INVENTION

Steam cleaning appliances require a substantial amount of power to operate properly. Typically, steam cleaning appliances require around 1,800 Watts of power to sufficiently heat stored water to provide the necessary steam for the cleaning appliance.

Similarly, steam irons require a substantial amount of power to operate properly. Steam irons generally include two heating elements, one to heat the iron and the other to heat water to produce steam. In the United States, the combined amount of electrical power utilized by both heating elements in a steam iron can not exceed, for practical purposes, 1,800 Watts due to UL regulations limiting voltage levels to 120 volts, with a maximum draw of 15 amps at this voltage level.

Given the above-mentioned power constraints, a device that combines a steam cleaner with a steam iron would not be able to draw sufficient power to power the separate heating elements of the combined device. One attempt to overcome this problem is disclosed in European Patent No. EP 0 809 728 B1, but the design shown therein is intended for use in Europe, which has 220 voltage levels and power standards suitably high that provide sufficient power to a device that includes both a steam cleaner and a steam iron.

Presently available combined steam cleaner and steam iron apparatus, such as that device which is described in commonly owned U.S. Pat. No. 6,711,840 incorporated by reference herein, overcomes the aforementioned problem; yet, the design requires a first and a second boiler element. As such, there exists a need for a combined steam cleaner having a reduction of the components necessary to perform the desired function and, thereby, enabled to reduce the cost of the combined apparatus.

Accordingly, it is desirable to provide a simple, low cost, combined steam cleaner and steam iron apparatus designed to properly operate under restricted power requirements.

SUMMARY OF THE INVENTION

Generally speaking, in accordance with the invention, a combination steam cleaner and steam iron that includes a steam generator, a steam cleaner and a steam iron is provided. The steam generator includes a boiling device that has a voltage or power control device and a boiler element for boiling water to produce steam, and a first connector for supplying out the steam. The voltage control device includes a resistive circuit wherein the maximum power that the boiler element can receive can be divided down to a predetermine proportion of the maximum power using the resistive circuit within the voltage control device connected in series with the boiler element. The steam cleaner includes a second connector that is attachable to the first connector of the steam generator, and the second connector includes a steam hose that receives the steam output from the steam generator. The steam cleaner also includes a steam nozzle that dispenses the steam and a circuit that is designed to supply power to the boiler element in the steam generator so as to short the voltage control device and provide power at the maximum power to boil the water when the steam cleaner is in use. The steam iron includes an iron heating element and a third connector that is attachable to the first connector of the steam generator. The third connector includes a steam hose that receives steam supplied out from the steam generator when the steam iron is attached, and steam iron also includes a circuit designed to supply power to the iron heating element to heat the steam iron when in use, and the circuit is designed to supply power to the boiler element so that the boiler element is enabled to supply power at the maximum power divided down by the predetermined proportion and the power supplied to the iron heating element is the maximum power reduced by the power supplied to the boiler element.

A power cable extends from the steam generator for receiving a source of power, and the steam generator includes a user controllable power switch for selectively supplying power to the boiler element and a steam release valve for controlling the output of steam from the steam generator through the first connector, and the steam cleaner and the steam iron each includes a respective user controlled on/off steam switch for controlling the steam release valve when the respective device is connected to the steam generator.

A power is supplied to the steam release valve independent of whether power is supplied by the power switch to the boiling device so that steam is controlled to be supplied out from the steam generator independent of control of the boiling device.

Each of the connectors of the steam generator, steam cleaner and steam iron includes respective first, second, third and fourth electrical contacts. Within the steam generator, the power switch supplies power to the first electrical contract, an electrical connection is provided between the second electrical contract a node between the serially connected the voltage control device and boiler element, the steam release valve's return line is electrically connected to the third electrical contact, and the fourth electrical contact is electrically connected to the power cable's return line. Within the steam cleaner, the first and second electrical contacts are shorted together, so as to short circuit the voltage control device and enable the boiler element to supply maximum power. The third and fourth electrical contacts are connected through the user controlled on/off steam switch. Within the steam iron, the first and fourth electrical contacts are connected through the iron heating element, the third and fourth electrical contacts are connected through the user controlled on/off steam switch, and the second electrical contact is left open.

The boiler element is an 1,500 Watt (up to 1,800 Watt) heater and the iron heating element is a 600 Watt heater. About 1,800 Watts of power are drawn during use of the steam cleaner and about 1,800 Watts of power are drawn during use of the steam generator and the steam iron.

A 120 voltage source of power is supplied to the power cable extending from the steam generator, where the steam generator draws less than 15 amps of power during use of the steam cleaner, and the steam generator and the steam iron collectively draw less than 15 amps of power during use of the steam iron.

The steam generator includes a pressostat, a thermostat and a thermofuse serially coupled to the boiler element. The steam generator also includes a top surface designed for use as a resting surface on which either the steam cleaner or the steam iron may be mounted. The top surface is designed to support a heated steam iron.

Accordingly, it is an object of the invention to provide a combined steam cleaner and steam iron apparatus that operates effectively at 15 amps.

It is another object of the invention to provide a combined steam cleaner and steam iron apparatus designed to provide a minimum number of contacts between the various interchangeable components.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

BRIEF DESCRIPTION OF THE DRAWINGS

The following detailed description, given by way of example and not intended to limit the invention solely thereto, will best be appreciated in conjunction with the accompanying drawings, wherein like reference numerals denote like elements and parts, in which.

DESCRIPTION OF PREFERRED EMBODIMENTS

Figure 1:
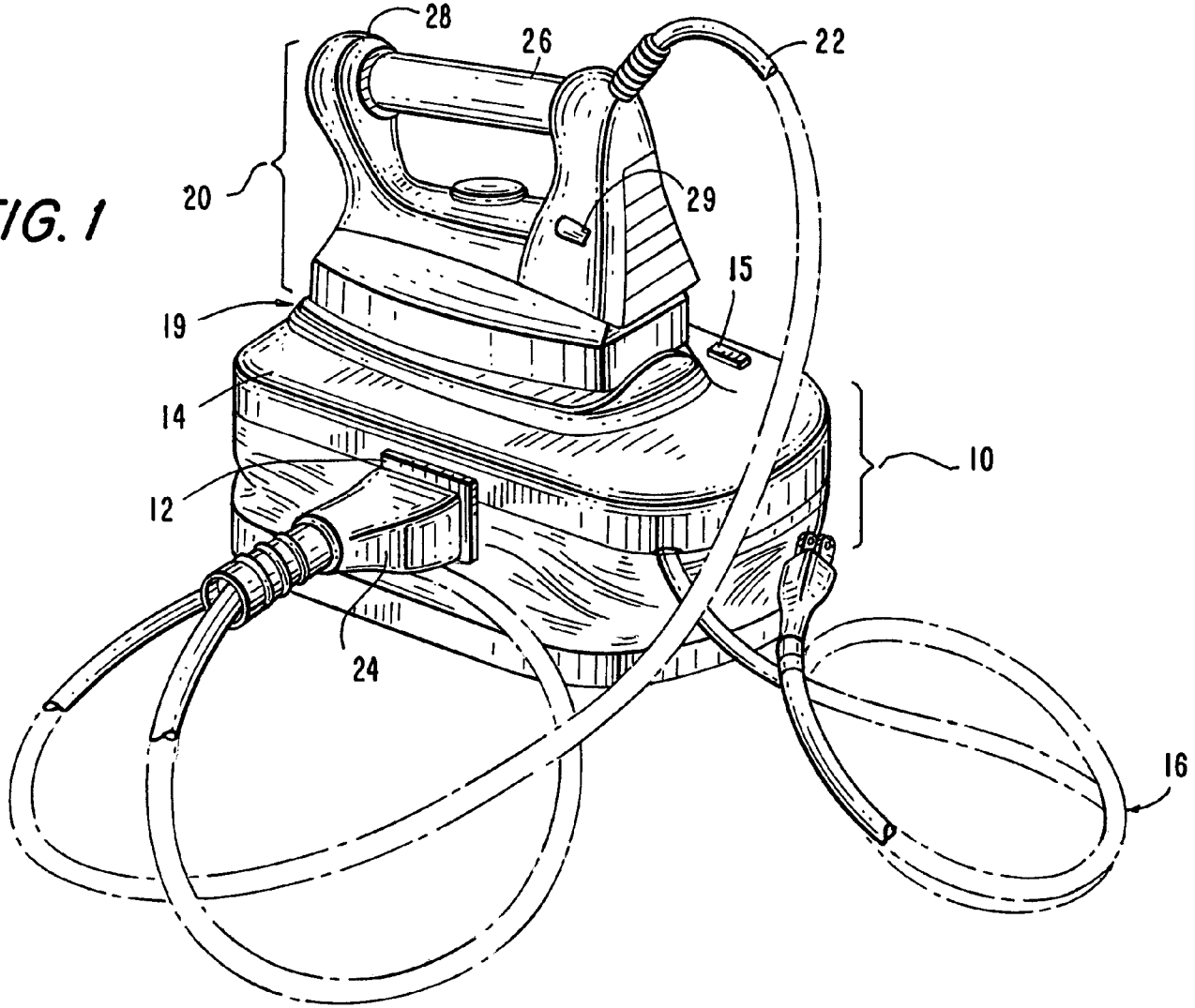
FIG. 1 is an illustration of the combined steam cleaner and steam iron apparatus of the invention, shown with the steam iron attached.
Figure 2:
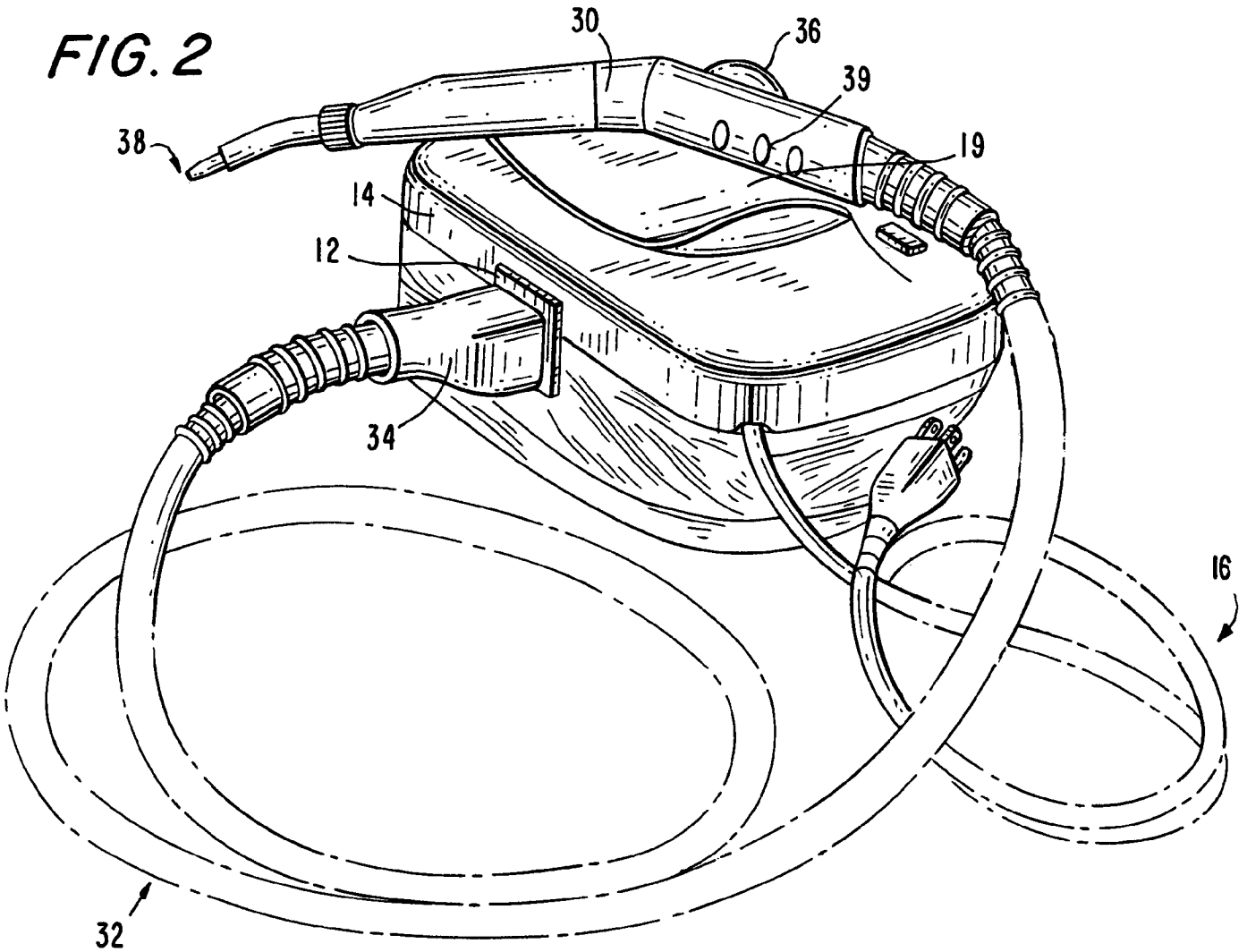
FIG. 2 is an illustration of the combined steam cleaner and steam iron apparatus of the invention, shown with the steam cleaner attached.

FIGS. 1 and 2 collectively illustrate the combined steam cleaner and steam iron apparatus of the invention. FIG. 1 shows a steam generating unit 10 with a steam iron 20 resting on top of and physically attached to the steam generating unit 10 via a steam iron hose 22. FIG. 2 shows a steam cleaner 30 resting on top of and physically attached to the steam generating unit 10 via a steam cleaner hose 32.

Figure 3:
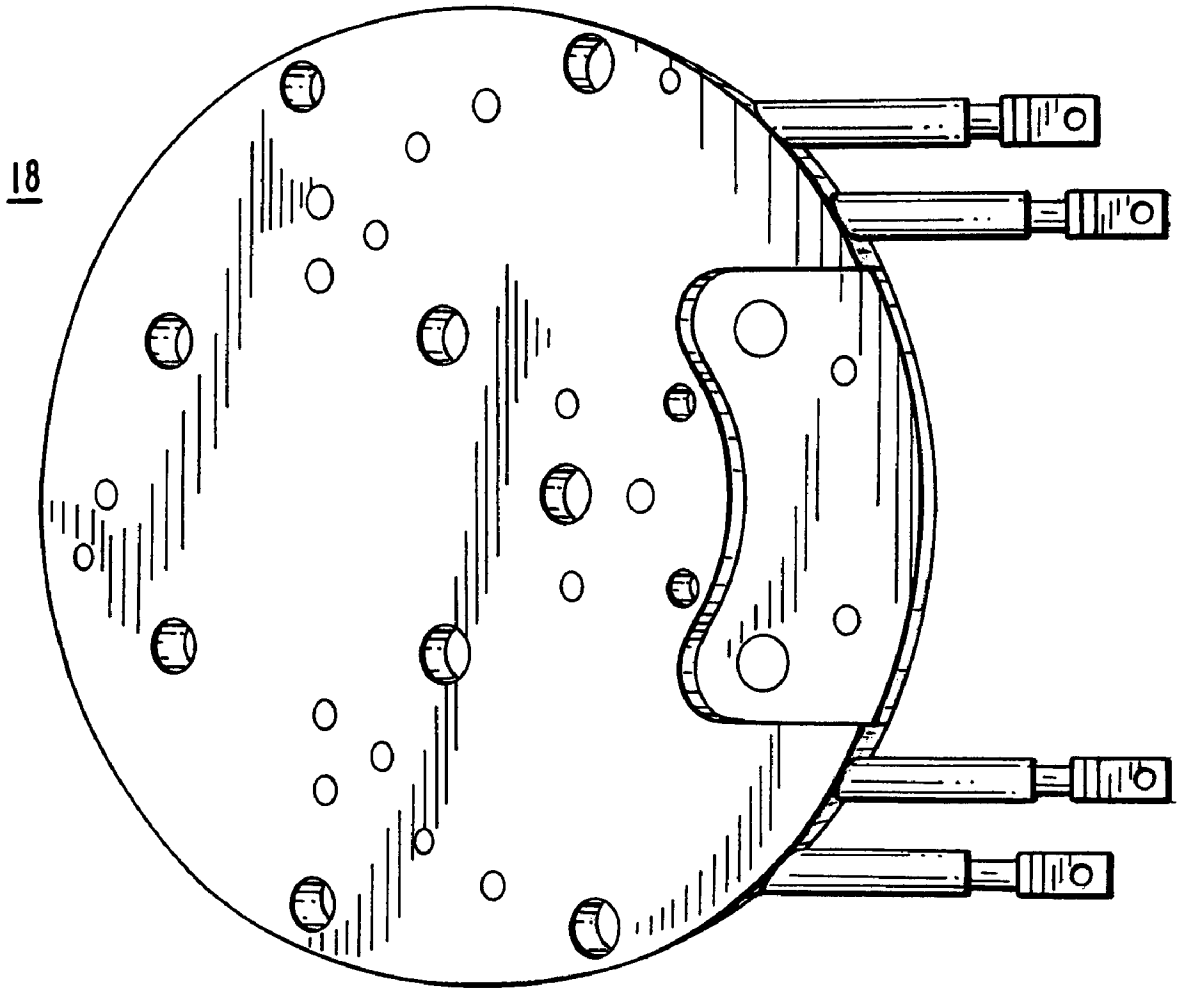
FIG. 3 is an illustration of a split heating element used within the combined steam cleaner and steam iron apparatus of the invention.

Steam generating unit 10 receives electrical power via a power cable 16 that is connected to a suitable power receptacle during operation of the apparatus of the invention. Steam generating unit 10 includes within its housing 14 a main on/off switch (with on/off light) 17 and also includes a split heating element 18, which is shown in FIG. 3. As further discussed below, split heating element 18 is utilized to provide steam for use by both the steam iron and the steam cleaner of the invention. As also shown, steam generating unit 10 includes a top surface 19 designed for use as a resting surface for either the steam iron 20 or the steam cleaner 30.

Referring back to FIG. 1, steam iron hose 22 extends from the steam iron 20 and a steam iron plug 24 (also called connector) extends from the other end of the steam iron hose 22. Steam iron plug 24 is insertable into (i.e., can mate with) a socket 12 disposed within the housing 14 of the steam generating unit 10. As shown in the exemplary design of FIG. 1, steam iron 20 includes a handle 26, an on/off switch 28 and an on/off light 29. During use of the steam iron 20 of the invention, the steam iron plug 24 is inserted into socket 12.

Referring to FIG. 2, steam cleaner hose 32 extends from the steam cleaner 30 and a steam cleaner plug 34 extends from the other end of the steam cleaner hose 32. Like the steam iron plug 24, the steam cleaner plug 34 also can be inserted into socket 12 of the steam generator's housing 14. The steam cleaner 30 includes an on/off switch 36 and a nozzle 38 through which steam is supplied, as further discussed below. The steam cleaner 30 may also include a hand grip 39 for comfort.

Figure 4:
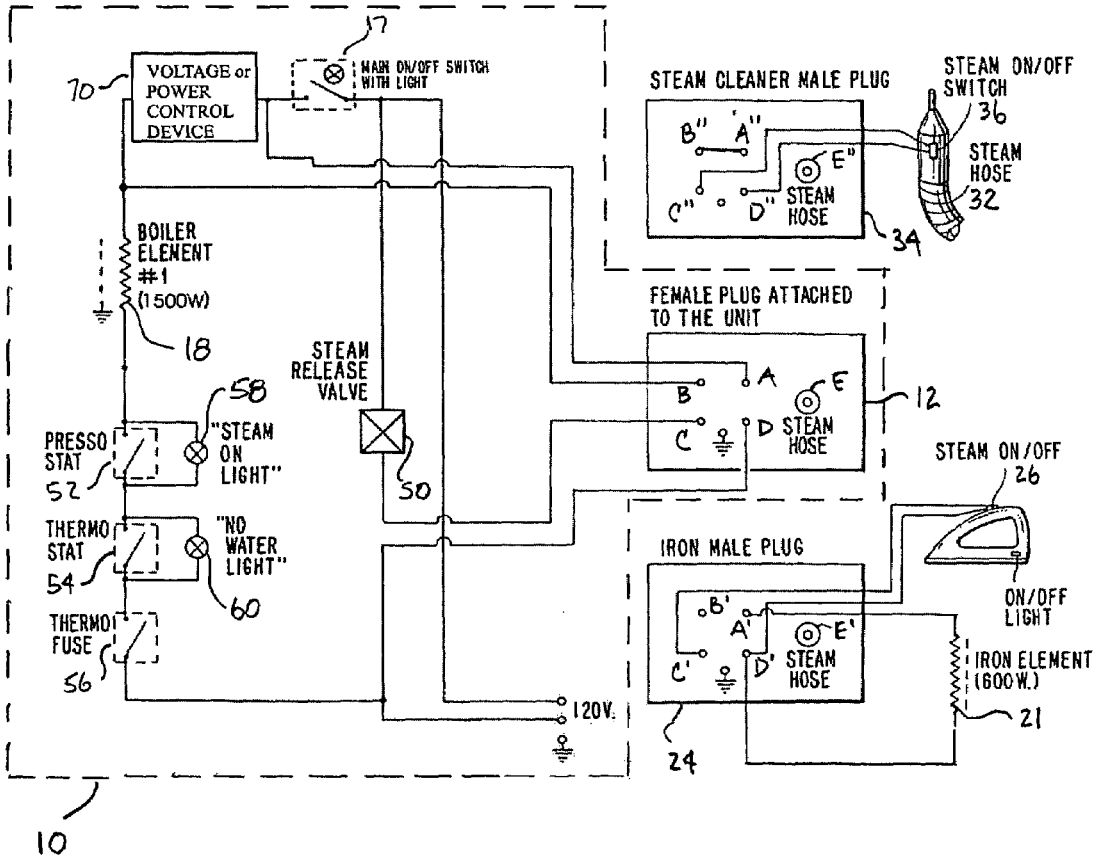
FIG. 4 is a schematic illustration of an electrical circuit of the combined steam cleaner and steam iron apparatus of the invention.

FIG. 4 is a schematic illustration of an embodiment of an electrical circuit of the combined steam cleaner and steam iron apparatus of the invention. During use of the invention, power cable 16 is coupled to an appropriate 120 volt power source (typically rated at 15 Amps) with a return line. The power source is supplied to both the main on/off switch 17 disposed within the steam generating unit's housing 14, as well as to a steam release valve 50 disposed within the steam generating unit 10. The output (also called switched power herein) of the main on/off switch 17 is supplied to voltage control device 70, wherein the voltage control device 70 includes a resistive circuit (not shown) that divides down the maximum power that boiler/heating element 18 can generate by a factor that can be predetermined by a manufacturer. Boiler element 18 is a 1,500 Watt (up to 1,800 Watt) heater device and operates to boil water within the steam generating unit 10 during use of either the steam cleaner 30 or the steam iron 20. Boiler element's 18 return line is serially supplied through three safety devices: a pressostat 52, a thermostat 54 and a thermofuse 56. Also, a "steam on" light 58 is coupled across pressostat 52, and a "no water" light 60 is coupled across thermostat 54. The respective operations of these various safety devices are well known in the art and thus further description is not provided herein.

The switched output from main on/off switch 17 also is supplied to contact A of the steam generator unit's socket 12, and contact B of socket 12 is connected to a node between voltage control device 70 and boiler element 18. The boiler element's 18 return is serially supplied through the safety devices 52, 54 and 56 mentioned above. As further discussed below, power supplied to contact A is routed back through contact B and then to boiler element 18 of the split heating elements of heating element 18 when the steam cleaner 30 is in use. When the steam iron is in use, power supplied to contact A is supplied to an iron element heater 21 disposed within the steam iron 20.

Power is supplied to steam release valve 50, as previously mentioned, and the valve's return line is coupled to contact C of socket 12. Contact D of socket 12 is supplied to the return line. Both steam iron 20 and steam cleaner 30 include respective on/off switches 28 and 36. When either the steam iron or the steam cleaner is connected to steam generating unit 10 (via their respective plugs 24 and 35), switching on the on/off switch (28 or 36) of the attached device (steam iron 20 or steam cleaner 30) completes the circuit through steam release valve 50 thus causing steam to be released from the steam generating unit 10 via hose connection E (also called steam output port) within socket 12 through the particular hose attached (22 or 32) and then to the particular device in use (steam iron 20 or steam cleaner 30). As mentioned above, power is supplied directly (i.e., not switched power) to steam release valve 50 and thus the on/off switch (either 28 or 36) of the attached device (the steam iron or the steam cleaner) controls steam release valve 50 independent of whether power is being supplied to any of the heater elements.

The steam iron 20 contains an electrical circuit as shown in FIG. 4. Plug 24 includes four electrical contacts A', B', C' and D' that mate with contacts A, B, C and D, respectively, of the steam generator's socket 12 when plug 24 and socket 12 are attached to one another. Contact A' is connected to one of the steam iron element 21's electrical contacts with the iron element's return attached to contact D'. Contacts C' and D' are attached through steam on/off switch 28 of the steam iron. Contact B' is left open. The steam iron hose 22 terminates at steam hose connector E' (also called steam input port) within the steam iron's plug 24. When the steam iron is attached to the steam generator, steam iron hose 22 receives the output of steam release valve 50 via hose connector E (within socket 12) and hose connector E' (within plug 24).

The steam cleaner 30 also contains an electrical circuit as shown in FIG. 4. Plug 34 includes four electrical contacts A", B", C" and D" that mate with contacts A, B, C and D, respectively, of the steam generator's socket 12 when plug 34 and socket 12 are attached to one another. Contacts A" and B" are electrically shorted. Contacts C" and D" are attached through steam on/off switch 36 of the steam cleaner. The steam cleaner hose 32 terminates at steam hose connector E" (also called steam input port) within the steam cleaner's plug 34. Similar to the steam iron, when the steam cleaner is attached to the steam generator, steam cleaner hose 32 receives the output of steam release valve 50 via hose connector E (within socket 12) and hose connector E" (within plug 34).

The operation of the invention when the steam iron is attached to the steam generating unit will now be described. The steam iron's plug 24 is first attached to the steam generator's socket 12, such as previously mentioned, so that the output of steam release valve 50 is supplied to steam iron hose 22, the switched power output from main on/off switch 17 is supplied to iron element heater 21 within the steam iron 20, and steam release valve 50 is controlled by steam on/off switch 28 also within the steam iron 20. The steam generator 10 is filled with water in a manner well known in the art, and the main on/off switch 17 is manually set to "on" to power both boiler element 18 within the steam generator 10 and to power iron element heater 21 within the steam iron 20. Since contact B' is left open, voltage control device 70 is serially connected to boiler element 18 and, thereby, the amount of power that the boiler element 18 is enabled to provide is the maximum power (1500 Watts up to 1800 Watts) factored down by the resistive circuit of the voltage control device 70. The amount that the power delivered by boiler element 18 is factor down is dependent upon the design of the resistive circuit (not shown). With the given constraints of 1800 Watts, the factor must be less than or equal to approximately 70% in order for the iron to be supplied with the 700 Watts while the boiler is supplied 1100 Watts, simultaneously. Collectively, the steam generator 10 and the steam iron 20 draw less than 15 amps of power (120 volts). During this time, steam on/off switch 28 on the steam iron is kept off. Boiler element 18 causes the water within the steam generator to boil to produce steam, and iron element heater 21 heats the bottom surface of the steam iron 20. Upon sufficient heating of steam iron 20 by iron element heater 21, ironing is carried out in a manner well known in the art. Likewise, steam produced within steam generator 10 is supplied through the steam iron upon switching steam on/off switch 28 to its on position (or depression of a button or other suitable on/off device). As previously mentioned, during use of steam iron 20, the steam iron may be conveniently placed on the top surface 19 of the steam generator. Upon completion of steam ironing, both main on/off switch 17 and steam on/off switch 28 are set to "off" and plug 24 is removed from the steam generator's socket 12.

To utilize the steam cleaner 30, the steam cleaner's plug 34 is attached to socket 12 of the steam generator. As previously mentioned, such connection provides the switched power (output from main on/off switch 17) to boiler element 18 alone where the voltage control device 70 is shorted out since contacts A" and B" are electrically shorted. The effect of this shorting of the circuit around the voltage control device 70 is that the resistance of the voltage control device 70 is eliminated which enables boiler element 18 to provide maximum power of 1500 Watts up to 1800 Watts to the boiler for boiling the water to generate steam. The output of steam release valve 50 is supplied to steam cleaner hose 32, and steam release valve 50 is controlled by steam on/off switch 36 within the steam cleaner 30. The steam generator 10 is filled with water and the main on/off switch 17 is set to on to power boiler element 18 at the maximum power of 1500 Watts up to 1800 Watts. Boiler element 18 draws less than 15 Amps of power (120 volts)). Steam on/off switch 36 on the steam cleaner is initially kept off. Steam cleaning then is achieved by turning steam on/off switch 36 on to supply the steam through the steam cleaner hose 32 and out through nozzle 38. Upon completion, both switches 17 and 36 are turned off and the connectors are detached.

As can be appreciated from the foregoing discussion and designs shown in FIG. 4 of the invention, the hereindescribed combination steam cleaner and steam iron properly functions within the confines of a 1,800 watts (120 volt; 15 amps) source of power. The inventive design further advantageously minimizes the size and number of contacts required for the various plugs and sockets of the combination's components. It is also noted that the voltage supply can be an amount of voltage other than the 120 volt power supply which is shown in FIG. 4.

While the invention has been particularly shown and described in conjunction with various embodiments thereof, it will be readily appreciated by those of ordinary skill in the art that various changes may be made without departing from the spirit and scope of the invention. For example, the invention has been described as including a housing socket and plugs for the steam cleaner and steam iron. Of course, the particular style of connector used for the steam generator, steam cleaner and steam iron may be different from that discussed herein.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall there between.

What is claimed is:

1. A combination steam cleaner and steam iron, comprising:

a steam generator having a boiling device having a voltage control device and a boiler element for boiling water at a maximum power to produce steam, wherein the voltage control device includes a resistive circuit that divides the maximum power generated by the boiler element down by a predetermined proportion, the steam generator including a first connector for outputting the steam;

a steam cleaner having a second connector attachable to the first connector; said second connector including a steam hose for receiving steam supplied out from the first connector when attached to the second connector; the steam cleaner further including a steam nozzle for dispensing the steam received by the steam hose and a steam cleaner circuit adapted to supply power to the boiler element of the steam generator using the attached first and second connectors to short the voltage control device such that the power supplied to the steam cleaner is the maximum power; and a steam iron having an iron heating element, said steam iron having a third connector attachable to the first connector, the third connector including a steam hose coupled to receive steam supplied out from the first connector when attached to the third connector; the steam iron further including a steam iron circuit adapted to couple to the voltage control device and the boiler element coupled in series to supply power such that the power supplied to the boiler element is the maximum power divided down by the predetermined proportion and the power supplied to the iron heating element is the maximum power reduced by the power supplied to the boiler element, wherein the power supplied to the iron heating element heats the steam iron when the first and third connectors are attached.

2. The combination of claim 1, further comprising:

a power cable for receiving a source of power, said power cable supplying power to the steam generator;

wherein said steam generator includes a user controllable power switch for selectively connecting and disconnecting the supplied source of power to the boiler element, the steam generator also including a steam release valve for selectively controlling the output of steam from the steam generator through the first connector;

each of said steam cleaner and said steam iron including a respective user controlled on/off steam switch for controlling the steam release valve to output or not output the steam through the first connector when one of said second and third connectors is attached to the first connector.

3. The combination of claim 2, wherein the power supplied to the steam generator is supplied to the steam release valve independent of connection or disconnection of the supplied source of power to the boiling device by said power switch in the steam generator so that steam is controlled to be supplied out from the steam generator independent of the operation of the boiling device.

4. The combination of claim 2, wherein the first connector includes first, second, third and fourth electrical contacts, the user controllable power switch selectively supplying the source of power to the first electrical contract, an electrical connection being provided between the first electrical contract and the voltage control device, an electrical connection being provided between the second electrical contract and the boiler element, a return of the steam release valve being electrically connected to the third electrical contact, and the fourth electrical contact being electrically connected to a return of the power cable;

the second connector of the steam cleaner and the third connector of the steam iron each including respective first, second, third and fourth electrical contacts that are electrically connectable to the respective first, second, third and fourth electrical contacts of the first connector;

the first and second electrical contacts of the second connector being electrically shorted, and the third and fourth electrical contacts of the second connector being connected through the user controlled on/off steam switch in the steam cleaner so that, when the first and second connectors are attached, power supplied from the user controllable power switch is routed through the first and second connectors and back through the second electrical contact of the first connector to selectively supply the maximum power to the boiler element in the steam generator, and the user controlled on/off steam switch in the steam cleaner controls the steam release valve in the steam generator;

the first and fourth electrical contacts of the third connector of the steam iron being connected through the iron heating element in the steam iron, the third and fourth electrical contacts of the third connector being connected through the user controlled on/off steam switch in the steam iron, and the second electrical contact of the third connector being open so that, when the first and third connectors are attached, power is not routed back through the second electrical contact of the first connector so that the boiler element in the steam generator is not powered, the user controlled on/off steam switch in the steam iron controls the steam release valve in the steam generator, and the user controllable power switch controls the supply of power to the iron heating element, wherein the first electrical contact of the third connector connects to the first electrical contact of the first connector such that power supplied from the user controllable power switch is routed through the series connected voltage control device and the boiler element to selectively supply the predetermined proportion of power to the boiler element and the maximum power reduced by the predetermined proportion to the iron heating element.

5. The combination of claim 1, wherein the boiler element is substantially an 1,500 Watt up to 1,800 Watt heater and the iron heating element also is substantially a 600 Watt heater so that substantially 1,500 Watts up to 1,800 Watts of power is drawn during use of the steam cleaner when the first and second connectors are attached, and substantially 1,800 Watts of power also is drawn during use of the steam iron when the first and third connectors are attached.

6. The combination of claim 1, further comprising a 120 voltage source of power, and a power cable for supplying the 120 voltage source of power to the steam generator; the steam generator adapted to draw less than 15 amps of power during use of the steam cleaner when the second connector of the steam cleaner is attached to the first connector of the steam generator; and the steam generator and the steam iron collectively are adapted to draw less than 15 amps of power during use of the steam iron when the third connector of the steam iron is attached to the first connector of the steam generator.

7. The combination of claim 1, wherein the steam generator further includes a pressostat, a thermostat and a thermofuse serially coupled to the boiler element.

8. The combination of claim 1, wherein the steam generator includes a housing having a top surface adapted for use to mount thereon one of the steam cleaner and the steam iron in use.

9. The combination of claim 8, wherein the top surface of the housing of the steam generator is adapted to support the steam iron when the steam iron is being heated by the iron heating element.

10. A combination steam cleaner and steam iron, comprising:

a steam generator having a connector with a steam output port and four electrical contacts, a power cable for receiving a source of power and a return line, a controllable power switch for receiving the supplied source of power and selectively supplying the power as switched power, a voltage control device and a boiler element coupled in series between the switched power and the return line, a first connection to supply the switched power to a first of the four electrical contacts, a second of the electrical contacts connected to a node between the series connected voltage control device and the boiler element, a controllable steam release valve coupled between the power cable and a third of the electrical contacts, and a second connection to connect the return line to a fourth of the electrical contacts; a steam output of the steam release valve being supplied to the steam output port;

a steam cleaner having a steam cleaner connector with a steam input port and four electrical contacts attachable to the output port and the four electrical contacts, respectively, of the steam generator; the steam cleaner including a steam hose for receiving steam received by the steam input port, a nozzle for dispensing the steam received by the steam hose, an electrical connection between a first and a second of the electrical contacts of the steam cleaner connector, and a steam switch coupled between a third and a fourth of the electrical contacts of the steam cleaner connector; and a steam iron having a steam iron connector with a steam input port and four electrical contacts attachable to the output port and the four electrical contacts, respectively, of the steam generator; the steam iron including a steam hose for receiving steam received by the steam input port of the steam iron connector, an iron heating element coupled between a first and a fourth of the electrical contacts of the steam iron connector, and a steam switch coupled between a third and the fourth of the electrical contacts of the steam iron connector.

11. The combination of claim 10, wherein when a respective one of the steam cleaner connector and the steam iron connector is attached to the connector of the steam generator, the steam switch of said one of the steam cleaner and the steam iron is adapted to control the steam release valve independent of supply of the power as switched power by the controllable power switch in the steam generator so that steam is controlled to be supplied out from the steam generator independent of operation of the first and second boiler elements.

12. The combination of claim 10, wherein the boiler element draw substantially 1,500 Watts up to 1,800 Watts of power when the power is supplied as switched power to the boiler element when the steam cleaner connector is attached to the connector of the steam generator; and wherein the boiler element draws substantially 1,100 Watts of power and the iron heating element draws substantially 600 Watts of the switched power when the steam iron connector is attached to the connector of the steam generator.

13. The combination of claim 10, further comprising a 120 voltage source of power; and wherein the power cable receives the 120 voltage source of power; the steam generator is adapted to draw less than 15 amps of power during use of the steam cleaner when the steam cleaner connector is attached to the connector of the steam generator; and the steam generator and the steam iron collectively are adapted to draw less than 15 amps of power during use of the steam iron when the steam iron connector is attached to the connector of the steam generator.

14. The combination of claim 10, wherein the boiler element in the steam generator is coupled to the return line by a pressostat, a thermostat and a thermofuse in serial connection with one another.

15. The combination of claim 10, wherein the steam generator includes a housing having a top surface adapted for use to mount thereon one of the steam cleaner and the steam iron in use.

16. The combination of claim 15, wherein the top surface of the housing of the steam generator is adapted to support the steam iron when the steam iron is being heated by the iron heating element.

17. A combination steam cleaner and steam iron, comprising:

a steam generator having a connector with a steam output port and four electrical contacts, a power cable for receiving a source of power and a return line, a controllable power switch for receiving the supplied source of power and selectively supplying the power as switched power, a voltage control device and a boiler element coupled in series between the switched power and the return line, a first connection to couple the return line to a first of the four electrical contacts, a node between the voltage control device and the boiler element coupled to a second of the electrical contacts, a controllable steam release valve coupled between the power cable and a third of the electrical contacts, and a second connection to connect the supplied source of power to a fourth of the electrical contacts; a steam output of the steam release valve being supplied to the steam output port;

a steam cleaner having a steam cleaner connector with a steam input port and four electrical contacts attachable to the output port and the four electrical contacts, respectively, of the steam generator; the steam cleaner including a steam hose for receiving steam received by the steam input port, a nozzle for dispensing the steam received by the steam hose, an electrical connection between a first and a second of the electrical contacts of the steam cleaner connector, and a steam switch coupled between a third and a fourth of the electrical contacts of the steam cleaner connector; and a steam iron having a steam iron connector with a steam input port and four electrical contacts attachable to the output port and the four electrical contacts, respectively, of the steam generator; the steam iron including a steam hose for receiving steam received by the steam input port of the steam iron connector, an iron heating element coupled between a first and a fourth of the electrical contacts of the steam iron connector, and a steam switch coupled between a third and the fourth of the electrical contacts of the steam iron connector.

18. The combination of claim 17, wherein the boiler element draws substantially 1,500 Watts up to 1,800 Watts of power when the power is supplied as switched power to the boiler element when the steam cleaner connector is attached to the connector of the steam generator; and wherein the boiler element draws substantially 1,100 Watts of power and the iron heating element draws substantially 600 Watts of the switched power when the steam iron connector is attached to the connector of the steam generator.

19. The combination of claim 17, further comprising a 120 voltage source of power; and wherein the power cable receives the 120 voltage source of power; the steam generator is adapted to draw less than 15 amps of power during use of the steam cleaner when the steam cleaner connector is attached to the connector of the steam generator; and the steam generator and the steam iron collectively are adapted to draw less than 15 amps of power during use of the steam iron when the steam iron connector is attached to the connector of the steam generator.

20. The combination of claim 17, wherein the boiler element in the steam generator is coupled to the switched power by a pressostat, a thermostat and a thermofuse in serial connection with one another.

21. An electrical circuit for use with an electrical appliance under restricted power requirements, comprising:

a power input for receiving a source of power and a return line;

a user controllable power switch receiving the source of power received by the power input and for selectively supplying the source of power as switched power; the switched power being supplied to a first heater element within the electrical appliance, an voltage control device and the first heater element coupled in series between the switched power and the return line;

a connection coupling the return line to a first of four electrical contacts within a first connector, a node between the serially connected voltage control device and the first heater element electrically coupled between a second of the four electrical contacts within the first connector and the switched power;

a controllable steam release valve electrically coupled between the return line and a third of the four electrical contacts within the first connector;

an electrical connection between the received source of power and a fourth of the four electrical contacts within the first connector;

a second connector disposed within a first detachable unit of the electrical appliance and having four electrical contacts attachable to the first connector;

an electrical connection between a first and a second of the four electrical contacts within the second connector;

a first user controlled on/off switch disposed within the first detachable unit and electrically coupled between a third and a fourth of the four electrical contacts within the second connector;

a third connector disposed within a second detachable unit of the electrical appliance and having four electrical contacts attachable to the first connector;

an electrical connection extending from a first of the four electrical contacts within the third connector through a second heater element within the second detachable unit to a fourth of the four electrical contacts within the third connector; and a second user controlled on/off switch disposed within the second detachable unit and electrically coupled between a third and the fourth of the electrical contacts within the third connector.

22. The electrical circuit of claim 21, wherein the steam release valve is adapted to controllably supply heat produced by the first heater element to one of the first and second detachable units having the respective one of the second and third connectors attached to the first connector.

23. The electrical circuit of claim 21, wherein the heater element is adapted to draw substantially 1,500 Watts up to 1,800 Watts of power when the power is supplied as switched power to the first heater element; and wherein the second heater element within the second detachable unit draws substantially 600 Watts of the switched power when the third and first connectors are attached.

24. The electrical circuit of claim 21, further comprising a 120 voltage source of power supplying the 120 voltage source of power to the power input; and wherein the electrical circuit is adapted to draw less than 15 amps of power when the first and second connectors are attached; and the electrical circuit is adapted to draw less than 15 amps of power when the first and third connectors are attached.

* * * * *